US006085872A

United States Patent [19]

Gilliland et al.

[11] Patent Number: 6,085,872

[45] Date of Patent: Jul. 11, 2000

[54] ROPED HYDRAULIC ELEVATOR

[75] Inventors: Oscar Gilliland, Nesbit, Miss.; George J Thomas, Rayleigh, United Kingdom

[73] Assignee: Thyssen Elevator Holding Corporation, Troy, Mich.

[21] Appl. No.: 09/047,972

[22] Filed: Mar. 25, 1998

[51] Int. Cl.[7] ..... B66B 11/04

[52] U.S. Cl. ..... 187/253; 187/266

[58] Field of Search ..... 187/253, 266, 187/252, 406, 414, 409

[56] References Cited

U.S. PATENT DOCUMENTS

| | | | |
|---|---|---|---|
| 2,417,947 | 3/1947 | Reedy | 187/253 |
| 4,830,146 | 5/1989 | Nakamura et al. | 187/253 |
| 4,977,980 | 12/1990 | Hifumi | 187/1 R |
| 5,056,627 | 10/1991 | Pelto-Huikko | 187/20 |
| 5,238,087 | 8/1993 | Garrido et al. | 187/17 |
| 5,349,142 | 9/1994 | Hasegawa | 187/110 |
| 5,443,140 | 8/1995 | Nagel et al. | 187/253 |
| 5,653,311 | 8/1997 | Keikkinen et al. | 187/253 |

*Primary Examiner*—Kenneth W. Noland
*Attorney, Agent, or Firm*—White & Case LLP

[57] ABSTRACT

A roped hydraulic elevator has a hydraulic jack whose upper end, preferably the plunger end, is secured to an upper region of the elevator hoistway, and whose lower end is free to move vertically. A first sheave is supported by the lower end of the jack, and at least one overhead sheave is supported in the upper hoistway region. A rope has one end secured to the hoistway near the top of the hoistway. The rope extends downwardly, around the first sheave, upwardly from the first sheave to the overhead sheave, and downwardly from the overhead sheave to the car, where it is secured. Preferably, a counterweight is supported by the lower end of said jack. Also, preferably one or more guide rails and guide shoes are used to guide the movement of the jack lower end and counterweight. The elevator is relatively simple in design, and the roping system produces a 2:1 ratio of car movement to jack movement, which allows the use of a shorter jack or, alternatively, a greater range of car travel. The system has the advantage that the weight of the plunger, and the weight of the hydraulic fluid inside the jack, inherently act as a counterweight to the weight of the car. Thus, even if a separate counterweight were not to be used, the system reduces the energy needed to raise the car. It also offers the advantage that the rope can be connected to the car near its center of gravity, thereby reducing the load on the car guide rails and shoes.

6 Claims, 1 Drawing Sheet

ROPED HYDRAULIC ELEVATOR

FIELD OF INVENTION

The present invention relates to hydraulic elevators, and in particular to hydraulic elevators of the type in which the car is suspended on a rope and indirectly driven by the hydraulic jack.

BACKGROUND OF THE INVENTION

In one type of known hydraulic elevator, either a single hydraulic jack, positioned below the elevator car, or a pair of hydraulic jacks, located on opposite sides of the car, are connected to the car frame for raising and lowering the car between floors. In the case of a single jack elevator, the upper end of the plunger is connected to the underside of the car frame. In the case of a dual post elevator, the upper ends of the plungers are connected to the top of the car frame. The principal advantage of a dual jack elevator is that it does not require providing a jack hole below the elevator car, which is some installations is impractical. Dual post elevators, however, are generally more limited in the range of upward car travel which is available.

Hydraulic elevator systems are also known where, instead of connecting the plunger or plungers directly to the car frame, the plungers are coupled indirectly to the car frame by a rope and sheave arrangement to support the car and its load. Such an elevator is referred to as a roped hydraulic elevator.

The most common design for roped hydraulic elevators with capacities greater than 3,000 pounds is to use a pair ofjacks, located on opposite sides of the car. One jack is mounted on each side of the car adjacent to the car rails. A set of rails is required for each jack. A sheave is mounted on top of each jack. The ropes are attached to each side of the car, pass over the sheaves mounted on top of the jacks, and are attached to the pit floor.

This arrangement produces a 2:1 ratio of car travel to jack travel. However, the use of two hydraulic jacks requires the shaft to have a larger cross-sectional area, i.e., to accommodate both jacks and the car, and requires that the rails be designed with the capacity to absorb larger guide shoe loads caused by any hydraulic imbalances between the jacks.

There have also been proposals for roped hydraulic elevators which operate with only a single hydraulic jack. An example of such a roped hydraulic elevator is disclosed in U.S. Pat. No. 4,977,980. The hydraulic jack is located to one side the elevator car and has its cylinder end fixed relative to the shaft floor. A sheave is secured to the upper end of the plunger, and a pair of sheaves are secured to the underside of the car frame, on opposite sides thereof A rope has one of its ends secured to a beam located at the upper end of the elevator shaft, on the side of the car opposite to the jack. The rope extends downwardly to one of the car-mounted sheaves, crosses underneath the car to the other car-mounted sheave, and then continues upwardly to the sheave on top of the plunger. Thereafter, the rope extends downwardly, parallel to the jack, and is secured the shaft floor. When the jack plunger extends and retracts, the elevator car moves up and down.

U.S. Pat. No. 5,443,140 discloses a roped hydraulic elevator which is similar to U.S. Pat. No. 4,977,980 except that the second end of the rope, after passing under the elevator car and over the plunger-mounted sleeve towards the shaft floor, is not secured to the shaft floor. Instead, the rope passes under another sheave mounted at the base of the plunger, extends upwardly and around a second sheave mounted on top of the plunger, and finally extends downwardly and is secured to the shaft floor. In addition, a counterweight rope extends from the plunger, over a pair of sheaves located at the top of the elevator shaft, to a counterweight. With this roping arrangement, the car will move twice the distance of plunger movement.

U.S. Pat. No. 5,056,627 discloses another example of a roped hydraulic elevator with a single jack located beside the car. A first rope is attached to the car, extends over a sheave located at the upper end of the plunger, and then extends downwardly and is connected to one end of a lever which is pivotally secured to the jack cylinder. A compensation rope is connected to the opposite end of the lever. The compensation rope extends upwardly from the lever over a first sheave secured on the top of the car. The compensation rope then crosses the top of the car, extends under a second car-mounted sheave, and then continues upwardly to the top of the shaft, where it is secured.

U.S. Pat. No. 5,238,087 discloses another roped hydraulic elevator. A car and a counterweight are attached to opposite ends of a rope, which is entrained over an idler sheave at the top of the elevator shaft. The counterweight, in turn, is connected to a drive rope, which extends around a pair of vertically spaced pulleys carried on a common tube. The ends of the drive rope are attached to the elevator shaft, and a hydraulic jack is connected to the tube for moving the tube up and down. Due to the roping arrangement, there is a 2:1 ratio between the jack plunger movement and movement of the drive rope.

Another example of a roped hydraulic elevator is disclosed in U.S. Pat. No. 5,653,311. In this system, the bottom of thejack cylinder, rather than being secured to the shaft floor, is secured to the guide rails. A rope has one end secured to the car frame. The rope extends over a sheave mounted on the top of the jack plunger, downwardly to a second sheave mounted at the base of the jack cylinder, and then upwardly to the top of the plunger where it is secured. This roping system provides a 3:1 ratio between jack movement and car movement. As disclosed in the '311 patent, providing a roping arrangement where the distance of car travel is a multiple of the extension of the plunger is advantageous, because it reduces the length of the jack tube required to produce a desired range of car travel.

The foregoing proposals tend to require complex roping systems. It would be desirable to provide a roped hydraulic elevator which utilizes a single jack, counter-balances the weight of the car, and produces car movement which is a multiple of the jack extension, but which at the same time is less complex in design than the foregoing proposals.

SUMMARY OF THE INVENTION

A roped hydraulic elevator according to the invention has a hydraulic jack whose upper end, preferably the plunger end, is secured to an upper region of the elevator shaft. The lower end of the jack is free to move downwardly and upwardly as the jack extends and retracts. A first sheave is supported by the lower end of the jack so as to be moveable with said lower end, and at least one overhead sheave is supported in the upper shaft region. A rope has one end secured to the shaft near the top of the shaft. The rope extends downwardly, around the first sheave, upwardly from the first sheave to the overhead sheave, and downwardly from the overhead sheave to the car, where it is secured. Preferably, a counterweight is supported by the lower end of said jack. Also, preferably one or more guide rails and guide shoes are used to guide the movement of the jack lower end and counterweight.

A roped hydraulic elevator according to the invention is relatively simple in design. The roping system produces a 2:1 ratio of car movement to jack movement, which allows the use of a shorter jack or, alternatively, a greater range of car travel. The system has the advantage that the weight of the plunger, and the weight of the hydraulic fluid inside the jack, act as a counterweight to the weight of the car. Thus, even if a separate counterweight were not to be used, the system reduces the energy needed to raise the car. It also offers the advantage that the rope can be connected to the car near its center of gravity, thereby reducing the load on the car guide rails and shoes.

For a better understanding of the invention, reference is made to the following detailed description of a preferred embodiment, taken in conjunction with the drawing accompanying the application.

DETAILED DESCRIPTION OF PREFERRED EMBODIMENTS

Figure 1:
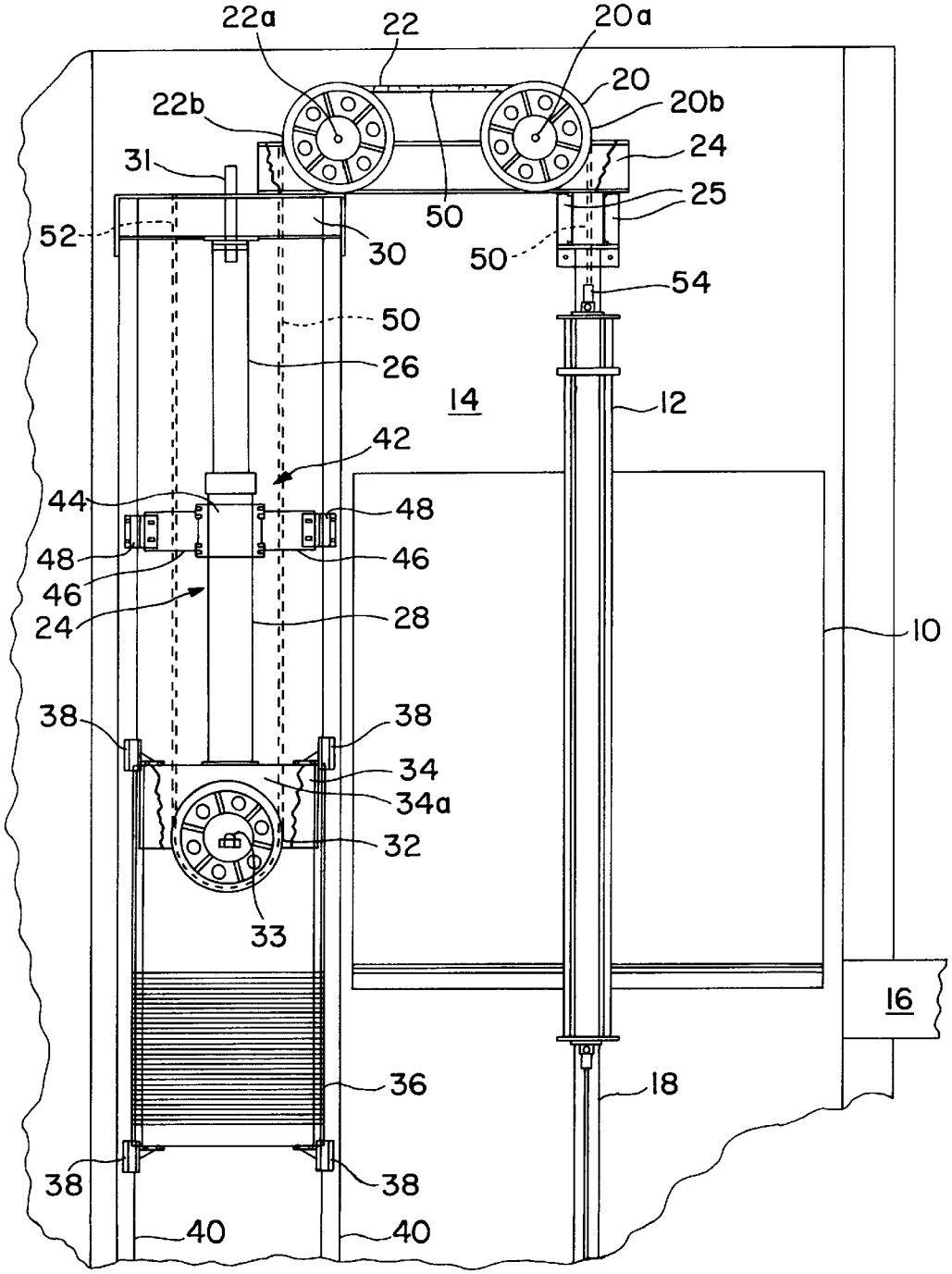
FIG. 1 is side, schematic view of a roped hydraulic elevator system according to the invention.

A roped hydraulic elevator system includes a car 10 which is supported in the customary manner by a frame or sling 12. The car 10 is vertically moveable in an elevator hoistway 14, such as an elevator shaft, between landings, one of which 16 is shown. While the hoistway 14 is shown as having walls, it may instead be defined by a single wall or by a frame structure. The car 10 is guided in the customary manner by a pair of guide rails 18 on opposite sides of the car, one of which is shown in FIG. 1.

A pair of overhead sheaves 20, 22 are rotatable on a pair of parallel, horizontal shafts 20*a*, 22*a*. The ends of the shafts 20*a*, 22*a* are supported by a pair of spaced, overhead support beams 24, 24*a*. The support beams 24, 24*a* are mounted on the car guide rails 18 and also on one of a pair of vertical guide rails 40 mounted to the hoistway wall. By mounting the support beams 24, 24*a* on the guide rails, vertical building loads are eliminated. The overhead sheaves 20, 22 are positioned such that their outwardly facing sides 20*b*, 22*b* are located over the center of gravity of the elevator and to the side of the car 10, respectively.

A hydraulic jack 24 includes a plunger 26 and a cylinder 28. The upper end of the plunger 26 is secured to on an overhead support beam 30 which, in turn, is secured to the guide rails 40. An inlet pipe 31 communicates with the interior of the jack 24 for supplying and venting hydraulic fluid.

A pair of spaced frame members 34, 34*a* are attached to the lower end of the cylinder 28. A sheave 32 is rotatable on a horizontal shaft 33, whose ends are supported by the frame members 34, 34*a*, such that the sheave is supported by the lower end of the cylinder 32 for movement therewith. The sheave 32 is centered on the jack axis, and preferably the sheave 32 and the two overhead sheaves 20 and 22 all lie in a common plane.

A counterweight 36 is hung from frame member 34, and a plurality of guide shoes 38 guide the lower end of the jack cylinder 28 and the counterweight 36 for movement along the vertical guide rails 40.

A second guide assembly 42 is provided at the upper end of the cylinder 28. The second guide assembly includes a collar 44 around the cylinder 28, and a pair of arms 46 carrying guide shoes 48 which slidingly engage the rails 40. In this manner, the cylinder 28 is secured against horizontal movement at both its top and bottom ends.

Finally, a rope 50, which is preferably a multifilament wire rope, has one of its ends 52 secured near the upper end of the hoistway 14, such as by being fixed to the overhead beam 30. The rope 50 extends downwardly to the cylinder-supported sheave 32, around the sheave 32, and upwardly to the overhead idler sheave 22. The rope 50 then extends horizontally to the other overhead sheave 20, and thereafter downwardly to the car sling 12, where its other end 54 is secured.

In operation, in order to raise the car, pressurized hydraulic fluid is supplied to inlet valve 31 in a manner which is well known and therefore need not be described further here. The introduction of pressurized hydraulic fluid into the jack causes the cylinder 28, and therefore the sheave 32, to move downwardly causing the car to move upwardly by a 2:1 ratio.

In order to lower the car, a valve (not shown) is opened to allow fluid to vent from the jack through pipe 31. The tension of the rope 50, caused by the weight of the car, will push the cylinder 28 upwardly, causing the jack 24 to contract and thus expelling hydraulic fluid from the cylinder. For such reason, in order to ensure that the car, even when empty and at its topmost position, will generate sufficient force to push the cylinder upwardly, the combined weight of the cylinder 28, hydraulic fluid in the jack, and counterweight should be a predetermined amount less than the empty car weight.

Orienting the jack such that the cylinder hangs below the plunger is preferable insofar as the cylinder tends to be heavier than the plunger, and therefore reduces the amount of mass needed in the counterweight. Also, locating the inlet pipe 31 at the top of the jack facilitates changing of the oil seal associated with pipe 31.

The foregoing represents preferred embodiments of the invention. Variations and modifications will be apparent to persons skilled in the art, without departing from the inventive concepts disclosed herein. All such modifications and variations are intended to be within the skill of the art, as defined in the following claims.

We claim:

1. A roped hydraulic elevator comprising:

an elevator hoistway having a plurality of landings;

a vertically oriented hydraulic jack having a cylinder and a plunger which is extendible from said cylinder, wherein said jack has an upper end fixedly supported against vertical movement relative to said hoistway in an upper region of said hoistway, and a lower end being freely moveable in a vertical direction;

a first sheave supported by said lower end of said jack so as to be moveable with said lower end;

at least one overhead sheave supported in said upper region;

a car vertically moveable between said landings;

a rope having one end secured to said hoistway in said upper region, said rope extending downwardly from said one end and around said first sheave, upwardly from said first sheave and about said overhead sheave, and downwardly from said overhead sheave to said car, wherein said rope has a second end secured to said car; and means for selectively supplying and withdrawing hydraulic fluid to and from said jack for selectively raising and lowering said car between landings;

wherein said lower end is associated with said jack cylinder, wherein said upper end is associated with said plunger, and wherein the plunger upper end is fixedly supported against vertical movement relative to said hoistway.

2. A roped hydraulic elevator according to claim 1, further comprising a plurality of guide rails for guiding the vertical movement of said lower end of said jack and for guiding the said car, and wherein the upper end of said jack and said at least one overhead sheave are supported by said guide rails.

3. A roped hydraulic elevator according to claim 1, wherein the plunger has a hollow bore for allowing hydraulic fluid to be supplied to and withdrawn from said cylinder.

4. A roped hydraulic elevator according to claim 1, further comprising a counterweight supported by the lower end of said jack.

5. A roped hydraulic elevator according to claim 4, further comprising a second overhead sheave, wherein the rope extends about said one overhead sheave and subsequently said second overhead sheave before extending downwardly to said car.

6. A roped hydraulic elevator according to claim 4, further comprising a guide for guiding the vertical movement of said counterweight.

* * * * *